United States Patent [19]

Edelman

[11] Patent Number: 4,533,165

[45] Date of Patent: Aug. 6, 1985

[54] LATCHING SYSTEM

[76] Inventor: Robert D. Edelman, 6678 Pickwick Dr., Cornwells Heights, Pa. 19020

[21] Appl. No.: 572,959

[22] Filed: Jan. 23, 1984

Related U.S. Application Data

[63] Continuation of Ser. No. 322,216, Nov. 17, 1981.

[51] Int. Cl.[3] ..... E05C 9/00

[52] U.S. Cl. ..... 292/68; 49/485; 292/7; 292/247; 312/215

[58] Field of Search ..... 292/66, 68, 113, 247, 292/DIG. 49, DIG. 31, 100, 93, 257, 248-250, 7, 29, 52; 70/208, 215; 24/68 R, 68 T, 68 SK, 71 T; 49/449, 485; 312/215

[56] References Cited

U.S. PATENT DOCUMENTS

| | | | |
|---|---|---|---|
| 1,566,689 | 12/1925 | O'Connor | 292/113 |
| 2,128,305 | 8/1938 | Lambert | 49/485 X |
| 2,424,962 | 8/1947 | Best . | |
| 2,477,472 | 7/1949 | Wright . | |
| 2,517,185 | 8/1950 | Elmer | 292/113 X |
| 2,652,277 | 9/1953 | Anderson | 292/66 X |
| 2,732,238 | 1/1956 | Dornberg . | |
| 2,741,507 | 4/1956 | Ambli | 292/113 X |
| 2,894,777 | 7/1959 | Hogan . | |
| 3,108,833 | 10/1963 | Christensen et al. | 292/113 |
| 3,214,207 | 10/1965 | Swanson . | |
| 3,259,411 | 7/1966 | Griffiths . | |
| 3,476,425 | 11/1969 | Chartrand | 292/100 X |
| 3,873,142 | 3/1975 | Reid | 292/68 X |
| 4,095,640 | 6/1978 | Beckerer | 49/485 X |
| 4,307,906 | 12/1981 | Schenk | 292/247 |
| 4,407,536 | 10/1983 | Kausch | 292/113 X |

FOREIGN PATENT DOCUMENTS

| | | | |
|---|---|---|---|
| 221429 | 7/1968 | Sweden | 292/DIG. 49 |
| 300427 | 10/1954 | Switzerland | 292/247 |
| 1286763 | 8/1972 | United Kingdom | 70/215 |
| 559017 | 9/1977 | U.S.S.R. | 292/247 |

OTHER PUBLICATIONS

Enclosure Corporation, "Shop Drawings for EMI Door w/ Paddlelatch", 10/4/79, 2 sheets.

*Primary Examiner*—Gary L. Smith
*Assistant Examiner*—Russell W. Illich
*Attorney, Agent, or Firm*—Caesar, Rivise, Bernstein & Cohen, Ltd.

[57] ABSTRACT

A latching system for releasably locking a door to a housing includes an actuating handle means rotatably connected to the door for controlling the operation of the latching system, and cooperable latching members connected to the housing and door, respectively. One of the cooperable latching members being rotatably connected to the handle means at a location spaced from the rotatable connection between the handle means and the door. Spring means engaging the latching member connected to the handle means for biasing it into a predetermined orientation relative to the handle means and for assisting in maintaining that predetermined orientation as the handle means is rotated in a first direction to move the latching member into engagement with the other cooperable latching member attached to the housing, and to thereafter permit relative rotational movement between the handle means and the latching member connected to it to thereby draw the door into sealing engagement with the housing.

6 Claims, 5 Drawing Figures

LATCHING SYSTEM

This application is a continuation of Ser. No. 322,216, filed Nov. 17, 1981.

FIELD OF THE INVENTION

This invention relates generally to a latching system, and more specifically to a latching system for establishing and maintaining an extremely tight closure between a door and housing.

BACKGROUND ART

There are many applications wherein it is necessary to house elements in a tightly sealed environment. For example, it is often necessary to house computer systems in cabinets that are capable of shielding the electronic components thereof against electromagnetic interference (EMI). An EMI cabinet for shielding such electronic components must employ an extremely tight sealing arrangement to accomplish its intended objective. It is quite common, particularly in large cabinets, to include a plurality of latches spaced along the door to provide, or insure that the door is tightly sealed against the cabinet housing.

In one prior art cabinet arrangement a vertically oriented actuating handle is pivotally connected to the door, and includes a plurality of vertically spaced-apart latching members that are actuated, in unison, by movement of the handle. Each of the latching members includes a helical groove for engaging with a keeper pin secured to the casing of a housing. When the door is in a closed position, the handle can be actuated to cause the helical groove of each latching member to slide into engagement with its associated keeper pin. Thereafter, continued movement of the latching members causes the helical grooves thereof to move relative to the pins and force the door into a tight, sealing relationship with the cabinet housing.

The above-described latching system has several inherent deficiencies. First, a high frictional force is established between the keeper pins and the walls of the helical grooves as the door is being forced tightly against the housing. This high frictional force tends to excessively wear both the pins and grooves to damage the latching system. Moreover, the orientation of the helical grooves relative to the pins tends to impose an extremely severe lateral force on the pins, which, after repeated opening and closing of the cabinet, can actually bend the pins laterally so that they are no longer functionally cooperable with their associated latching members.

U.S. Pat. No. 2,424,962, issued to Best, discloses a latch mechanism including a lever 24 that is pivotally interconnected intermediate its longitudinal ends through a pivot pin 32. The right end of the lever is employed as the handle to operate the system. Thus, the latching head and handle are part of a single member, and cannot move relative to each other.

U.S. Pat. No. 2,477,472, issued to Wright, relates to a self-locking latch employing a toggle lever 16 disposed between trigger lever, or handle 21, and a hook member 14. This a more complex system than one which does not require a toggle lever between the actuating handle and the latching member.

U.S. Pat. No. 2,732,238, issued to Dornberg, relates to a latching system in which relative movement takes place between a hook 28 and a lever 30 in order to bring the hook into engagement with lateral pin 23 to accomplish the locking operation. The arrangement of elements in this system is quite complex.

U.S. Pat. No. 2,894,777, issued to Hogan, discloses a latching system in which the path of travel of hook 8 is controlled by the dimensions and positions of two links 10 and 13. Moreover, movement of the hook 8 is accomplished through actuation, or movement of handle 21 and yoke lever 19. There are a significant number of links and interconnecting members required in the operation of the Hogan system; rendering it quite complex.

U.S. Pat. No. 3,214,207, issued to Swanson, includes a movable linkage arrangement between an actuating handle (e.g. 27) and a latching member or hook (e.g. 35). The introduction of additional linkage members between an actuating handle and latching member is more complex than a latching system wherein such additional linkage members can be omitted.

U.S. Pat. No. 3,259,411, discloses a system wherein a drawhook is directly connected through a rotatable connection to an actuating handle 26. In this device movement of the handle 26 in a clockwise direction, as viewed in FIG. 3, causes the drawhook 40 to ride along the bolt 18 until the latching action is complete. The drawhook 40 is maintained in engagement with the bolt through the action of a spring 46. Although this latching arrangement is somewhat less complex than several of the latching arrangements described heretofore, there is still a necessity to maintain the drawhook 40 in engagement with the bolt. The necessity of requiring the drawhook 40 to actually ride on the bolt to maintain the desired positional relationship between them is not believed to be the most desirable arrangement for latching systems of the type forming the subject matter of this invention.

SUMMARY OF THE INVENTION

A latching system for releasably locking a door to a housing, said system including:

actuating handle means rotatably connected to the door for controlling the operation of the system;

cooperable latching members associated with the door and housing, respectively, for engaging with each other to releasably lock the door to the housing;

one of the latching members being rotatably connected to the actuating handle means at a location spaced from the rotatable connection between the handle means and the door;

spring means engaging the latching member connected to the actuating handle means for biasing it into a predetermined orientation relative to the handle means and for assisting in maintaining that orientation as the handle means is rotated to bring said one latching member into engagement with the cooperable latching member associated with the housing, at which point additional movement of the actuating handle means causes its attached latching member to rotate about its rotatable connection to said handle means to force the door into tight sealing engagement with the housing.

The above arrangement has several advantages over the prior art constructions described earlier in this application. First, the latching member associated with the door is connected directly to the actuating handle means, without the interposition of additional toggle members or other complicating linkage systems. Therefore, applicant's system is considerably less complex than the prior art systems requiring the use of extraneous toggle members between an actuating handle and a latching member.

In applicant's device a spring means is employed to establish a predetermined orientation between the latching member and the actuating handle means and to assist in maintaining this orientation as the actuating handle means is operated to move the latching member into engagement with a cooperable latching member on the housing. It is only after the latching member connected to the actuating handle means engages the latching member associated with the housing that relative rotational movement takes place between the actuating handle means and its rotatably connected latching member. Prior to that time the latching member moves as a single unit with the actuating handle means in a predetermined arcuate path (e.g. a curved path having the rotatable axis of the actuating handle as its center). This provides precise control to bring the cooperable latching members into locking engagement with each other.

In a preferred embodiment of this invention the latching member associated with the housing is in the form of a hook member extending generally normal from the front face of the housing. The cooperable latching member is a link including a keeper pin adapted to be inserted within an opening in the hook member. Once the keeper pin is firmly seated within the opening of the hook member, the link will begin to rotate relative to the actuating handle and thereby apply a substantially linear force to the hook member in a direction generally perpendicular to the front wall of the housing. In other words, the linear force substantially aligns with the direction in which the hook member extends from the wall of the housing, thereby avoiding the imposition of excessive transverse forces on the hook member which could cause it to bend, or otherwise be damaged. Moreover, very little frictional force is encountered between the keeper pin and surfaces of the opening in the hook member as the keeper pin slides into engagement with the base of the hook member. The reason for this is that the high normal forces required to seal the door against the housing are not imposed upon either the link carrying the pin or the hook member until the keeper pin has been firmly seated against the base of the opening, and thereafter the link begins to rotate relative to the actuating handle to create the linear force necessary to seal the door against the housing. In other words, all sliding action between the keeper pin and the hook is accomplished prior to the imposition of the large normal forces required to seal the door against the housing.

In the most preferred embodiment of this invention a plurality of latching members are spaced vertically along the forward vertical edge of the door, and all of these latching members are simultaneously actuated by the same vertically extending actuating handle means. It is in this environment that it is most important to establish and maintain a given predetermined orientation between the handle means and the latching members connected to said handle means so that movement of the actuating handle means will simultaneously guide all of the latching members connected to it into engagement with spaced-apart cooperable latching members associated with the housing.

Other objects and advantages of this invention will become apparent by referring to the Description of the Preferred Embodiment of the Invention which follows, taken in conjunction with the accompanying drawings.

DESCRIPTION OF THE PREFERRED EMBODIMENT OF THE INVENTION

Figure 1:
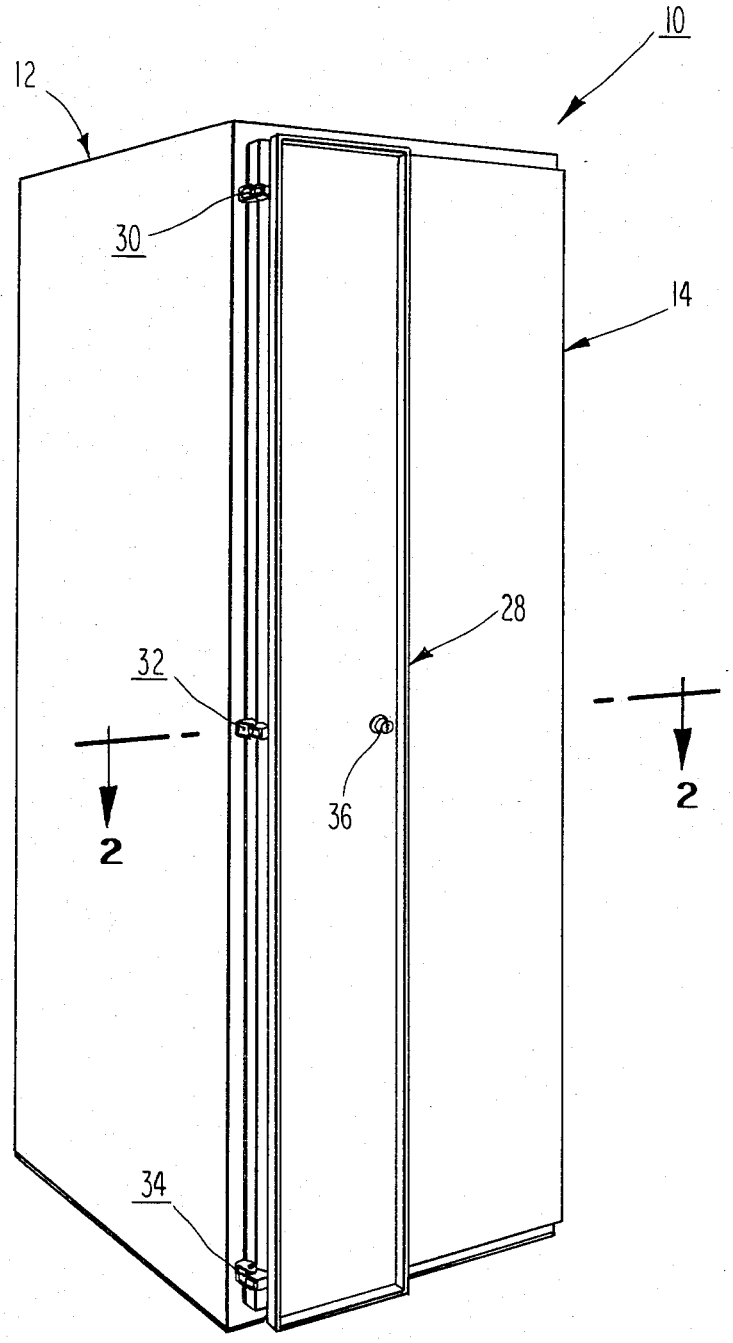
FIG. 1 is an isometric view of a cabinet employing the unique latching system of this invention.

Although specific terms are used in the following description for the sake of clarity, these terms are intended to refer only to the particular structure of the invention selected for illustration in the drawings, and are not intended to define or limit the scope of the invention.

Figure 2:
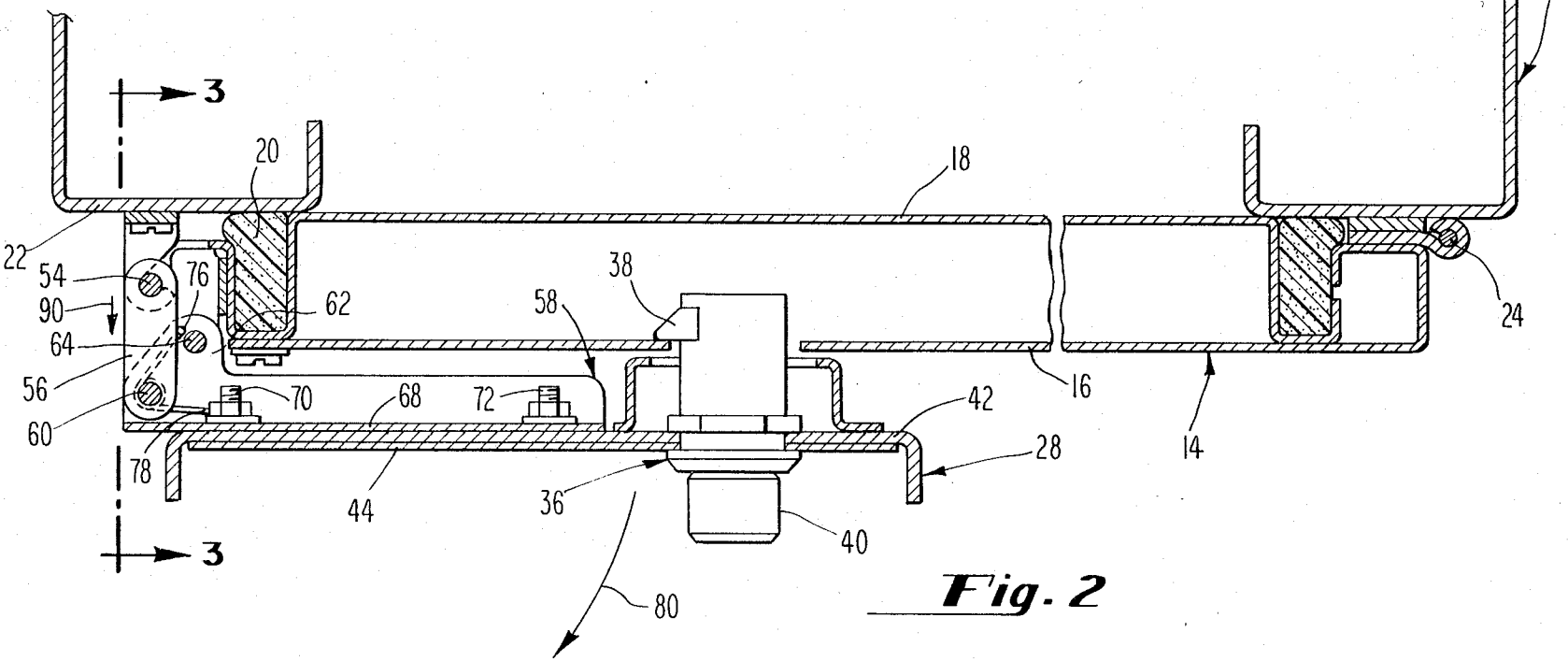
FIG. 2 is a sectional view taken along line 2—2 of FIG. 1.

Referring to specifically to FIGS. 1 and 2, a cabinet 10 employing the unique latching system of this invention is illustrated. The cabinet includes a housing 12, which, in the illustrated embodiment, is intended to house electronic components of a computer system. A door 14 includes panels 16 and 18 forming a hollow, double-walled construction, at least in the region overlying the opening into the housing 12. The door further includes gasketing material 20 positioned in grooves about the periphery of the door for providing a firm seal against the casing 22 of housing 12.

The door 14 preferably is provided with a hinge connection 24 at a rear longitudinal end thereof. A latching system is employed at the front end of the door, and includes an elongate, vertical actuating handle 28 for simultaneously controlling the operation of three separate locks 30, 32 and 34 (FIG. 1) of identical construction.

The handle 28 can be locked to the door 14 to prevent its inadvertent release when the cabinet is in a sealed, or tightly closed condition, as illustrated in FIG. 2. The lock can be of any conventional type, and is illustrated herein at 36. The lock includes a retractable keeper pin 38 that can be drawn into its housing by rotation of actuating knob 40. The keeper pin is snapped into locking engagement behind the outer panel 16 of the door 14 to maintain its locked position, as illustrated in FIG. 2.

The handle 28 includes a rigid steel flanged member 42 extending for substantially the entire vertical extent of the door 14. In the illustrated embodiment a decorative and durable panel 44 (e.g. Formica plastic panel) is adhesively secure to the front wall of the flanged member 42. Of course, the choice of material employed to form the flanged member, and the use of a decorative panel as described, are not limiting on the present invention. The important feature is that an elongate handle be provided that is capable of being actuated to provide a relatively large mechanical advantage for achieving the desired sealing action between the door 14 and the housing 12. The manner in which the latching member is operated to achieve this sealing motion will be described in detail later in this application.

Figure 3:
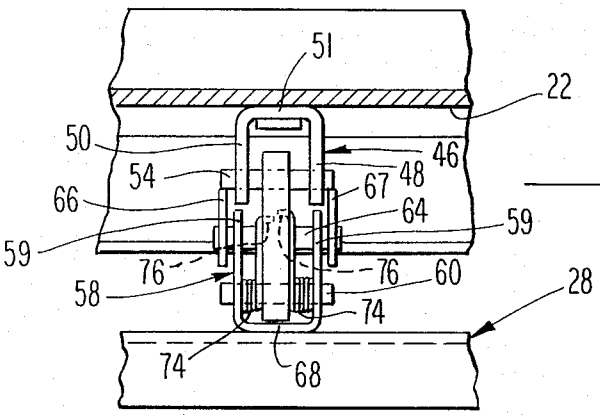
FIG. 3 is a sectional view taken along line 3—3 of FIG. 2.
Figure 4:
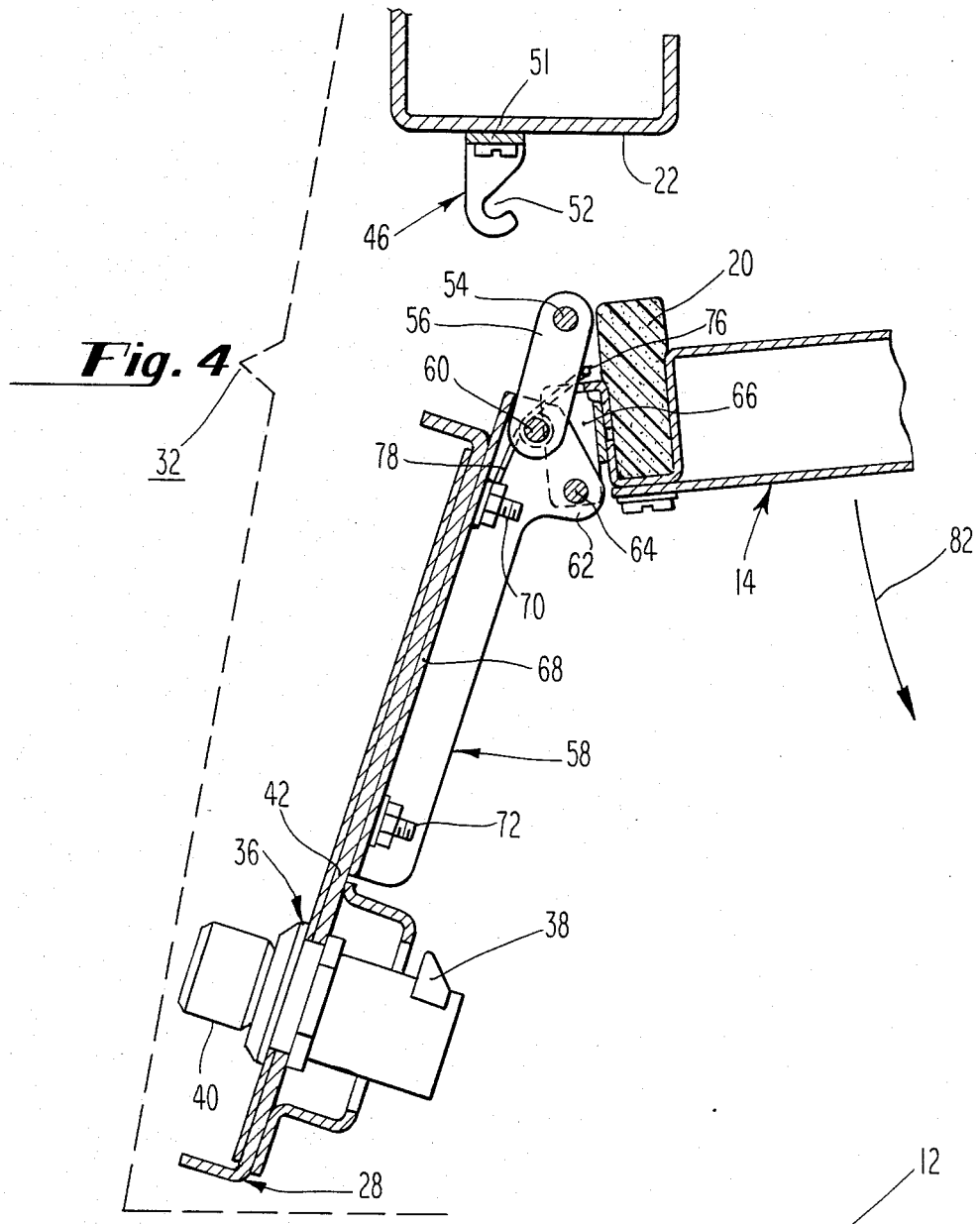
FIG. 4 is a view similar to FIG. 2, but with the door in an opened position relative to the housing of the cabinet.

Referring to FIGS. 2–4, lock 32 will be described in detail, it being understood that the additional locks 30 and 34 are of identical construction, and that their operation is controlled by the actuating handle 28 in the identical manner to be described in connection with the lock 32.

The lock 32 includes cooperable latching members associated with the housing 12 and the door 14, respectively. The latching member secured to the housing is in the form of a hook 46, being substantially U-shaped in cross-section (FIG. 3). In particular, the hook includes a base 51 that is bolted, or screwed into engagement with the casing 22 of the housing 12. Laterally spaced-apart arms 48 and 50 extend outwardly from the base, and include U-shaped openings 52 (only one being shown in FIGS. 4 and 5) for receiving a laterally extending keeper pin 54 forming a part of the cooperable latching member.

The keeper pin 54 is connected to a link 56 that, in turn, is rotatably connected to the actuating handle 28 through an actuating lever 58 that is substantially U-shaped in cross-section. A link pivot pin 60, spaced from the keeper pin 54 is employed to rotatably connect the link 56 to laterally spaced-apart arms 59 of the lever 58. The arms 59 include aligned projections 62 (only one being shown in FIGS. 2 and 4) through which the lever 58 is pivotally connected to the door 14 by a mounting pin 64. As can be seen best in FIG. 3, the pivot mounting pin 64 is retained within laterally spaced-apart extensions 66 and 67 joined, such as by welding, to a portion of the inner panel 18 of the door 14.

Referring to FIGS. 2–4, the actuating lever 58 includes a base, or front wall 68 connected to the flanged member 42 of the handle 28 through laterally spaced-apart bolts 70 and 72. In this manner the handle 28, in conjunction with the actuating lever 58 actually functions as a single unit to control the overall operation of the lock 32.

Still referring to FIGS. 2–4, a pair of coil springs 74 are wrapped about the link pivot pin 60 on opposite sides of link 56. One free end 76 of each spring is bent to engage the link 56 and bias it into engagement with the base, or front wall 68 of the actuating lever 58 when the keeper pin 54 is out of engagement with the hook 46 (e.g. FIG. 4). In this arrangement the link 56 forms an elongate linear extension of the lever 58, and therefore is capable of moving as a single unit with the handle 28 and lever 58, at least until the keeper pin 54 is seated into the base of the U-shaped opening 52 of the hook 46. Movement of the link 56 relative to the handle 28 and lever 58 after it engages the base of the U-shaped opening 52 will be described in detail hereinafter.

The opposite free end 78 of each of the coil springs 74 is spring loaded, or biased against the inner surface of the front wall 68 of the actuating lever 58 to maintain the spring in proper position.

The unique operation of the latching system of this invention will now be described.

Figure 5:
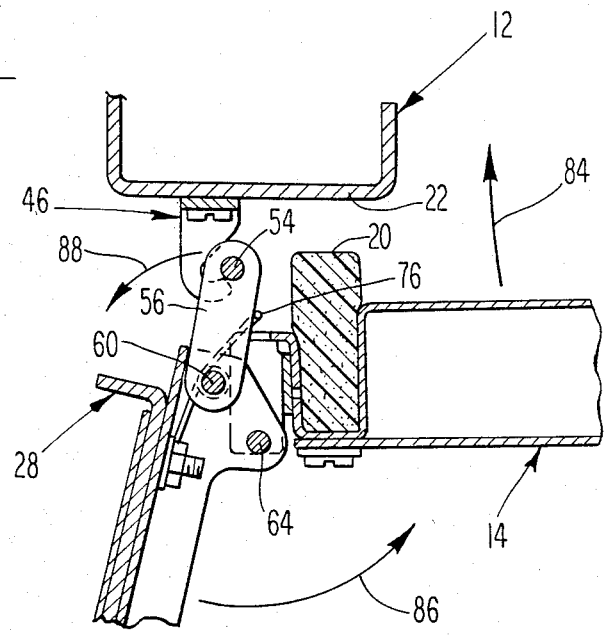
FIG. 5 is a fragmentary view, similar to FIG. 2, but showing the door in an intermediate position during the closing operation.

Referring to FIG. 2, the door 14 can be opened relative to the housing 12 by rotating the actuating knob 40 of the lock 36 to retract the keeper pin 38. This will permit movement of the actuating handle 28 and lever 58 in an outward direction about the mounting pin 64, in the direction of arrow 80. The offset relationship between the mounting pin 64 for the handle, and the link pivot pin 60 joining the link 56 to the actuating lever 58 causes the locking, or sealing pressure to be released as the actuating handle 28 is moved in the direction of arrow 80. Continued movement of the handle 28 will ultimately cause the link 56 to engage the front wall 68 of the lever 58, and thereafter out of the U-shaped opening 52 of hook 46 to a position such as is shown in FIG. 5. Further movement will cause the keeper pin 54 to completely clear the opening 52 to thereafter permit the door to be opened by rotational movement in the direction of arrow 82 (FIG. 4) about its pivot connection 24 (FIG. 2).

Referring to FIG. 5, the door 14 is sealed against the housing 12 by first moving the door in the direction of arrow 84, about pivot pin 24, into close proximity to the housing 12. This movement can be accomplished in any desired manner, either by engaging the handle 28 to rotate the door inwardly, or by actually pushing the body of the door. With the door 14 in substantially the position illustrated in FIG. 5, the actuating handle 28 is rotated in the direction of arrow 86 about its mounting pin 64. The link 56 will likewise move with the handle 28, as a continuous extension thereof, along the arcuate path illustrated by arrow 88. The link 56 will move as a unit with the handle 28, about mounting pin 64, until the keeper pin 54 is seated against the base of the U-shaped opening 52 of the hook member 46. Until the keeper pin 54 is so seated, there will be only a very minimal normal force between the keeper pin and the surfaces of the U-shaped opening. This minimizes frictional wear between the surfaces of the pin and opening, thereby overcoming one of the major deficiencies of several of the prior art devices.

Once the keeper pin 54 is seated at the base of the U-shaped opening in the hook 46, continued rotation of the actuating handle 28, in the direction of arrow 86, will overcome the biasing force of the springs 74 to permit, or cause relative rotational movement between the handle 28 and the link 56 about the link pivot pin 60. The offset relationship between mounting pin 64 and link pivot pin 60, in conjunction with the relative rotational movement of the link 56 about pin 60 creates a substantially linear pulling force on the link 56, substantially normal to the surface of casing 22 to which the hook 46 is secured. This linear force is generally illustrated by arrow 90 in FIG. 2. There will be some minor lateral force component as the link pivot pin 60 is rotated about the mounting pin 64 by movement of the actuating handle 28 into its closed position illustrated in FIG. 2. However, the lateral component of force is quite small, and will not impose an excessive lateral force on the hook 46 to either break or bend it. When the actuating handle 28 is moved into its completely closed position, as illustrated in FIG. 2, the keeper pin 38 of lock 36 will snap into latching engagement behind the inner surface of the outer door panel 16.

It is within the scope of this invention to form the handle 28 and actuating lever 58 as a single unit, or member. The important feature in accordance with this invention is that the element, or elements forming the actuating means for the lock 32 be designed to rotate as a single unit about the mounting pin 64, and that when the actuating means is formed of multiple elements, such elements not be rotatable relative to each other to accomplish the locking action.

Reference in this application, including the claims, to "actuating handle means" is intended to include either single element or multi-element constructions that are rotatable as a single unit about a pivot axis, as described in the preceding paragraph.

Although the present invention has been described with reference to the particular embodiment herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. The combination of a housing, a closure for said housing movable between opened and closed positions about a linear pivot axis, gasketing means between said closure and housing for assisting in providing a firm seal between said closure and said housing when said closure is locked in said closed position, and a latching system for releasably locking said closure to said housing when said closure is in a closed position; characterized in that the latching system includes an actuating handle means for controlling the operation of the latching system, said handle means being rotatably connected to said closure about a plurality of pivot mounting pin means, said pivot mounting pin means being aligned along an axis parallel to said linear pivot axis and each of said pivot mounting pin means being pivotally retained in axially spaced-apart members attached to said closure; a plurality of first latching members spaced-apart from each other in a linear direction parallel to the linear pivot axis, each of said first latching members being adapted to engage a second cooperable latching member connected to the housing for locking the closure to the housing; each of said first latching members being pivotally connected to the handle means at a fixed location through linearly aligned, spaced-apart connections for permitting rotational movement of each of said latching members relative to said handle means in a plane generally perpendicular to said linear pivot axis, said fixed location being offset from the axis along which the plurality of pivot mounting pin means are aligned; spring means engaging each of said first latching members for biasing each of said latching members into a predetermined orientation relative to the handle means and for assisting in maintaining said predetermined orientation when said handle means is rotated in a first direction to move each of said plurality of first latching members into engagement with said second cooperable latching members, and to thereafter permit relative rotational movement between said first latching members and the actuating handle means as said handle means is continuously moved in said first direction to thereby draw said closure toward the housing into sealing engagement therewith; the rotatable connections of the handle means to the closure always being located on the same side of an imaginary line between the fixed location at which each of the first latching members is connected to the handle means and the location where the respective first latching member engages its cooperable second latching member for maintaining the housing and closure in sealing engagement with each other, whereby a non-overcenter latching system is provided for the housing and closure, and lock means for removably securing the handle means to the closure for maintaining the closure in sealing engagement with the housing, rotational forces imposed on the handle means in a direction for rotating the handle means in a second direction away from said closure when said lock is unsecured being provided solely by said gasket means and said spring means.

2. The combination of claim 1 characterized in that a lock is provided on the handle means for removably securing the handle means to the closure for maintaining the closure in sealing engagement with the housing.

3. The combination of claim 2 characterized in that the lock includes a keeper pin engageable behind a panel of the closure to thereby lock the handle means to said closure.

4. The combination of claim 1 wherein said first latching members each include a keeper pin and said second latching members each include a hook member having an opening therein for receiving the keeper pins.

5. The combination of claim 4 wherein the spring means maintain each keeper pin in a predetermined orientation relative to the handle means until each said keeper pin completely seats against the base of the opening in the cooperating hook member, and thereafter permit relative rotational movement between the keeper pins and the actuating handle means.

6. The combination of claim 1 wherein the first latching members are non-adjustable members.

* * * * *